US006083025A

United States Patent [19]

Anbo et al.

[11] Patent Number: 6,083,025

[45] Date of Patent: Jul. 4, 2000

[54] CONNECTOR

[75] Inventors: Tsugio Anbo; Katsuzi Shimazawa; Yukifumi Machida; Yoshikatsu Hasegawa, all of Tokyo, Japan

[73] Assignee: Ryosei Electro-Circuit Systems Ltd., Tokyo, Japan

[21] Appl. No.: 09/030,070

[22] Filed: Feb. 25, 1998

[30] Foreign Application Priority Data

| | | | |
|---|---|---|---|
| Mar. 5, 1997 | [JP] | Japan | 9-067266 |
| Mar. 14, 1997 | [JP] | Japan | 9-082057 |
| Apr. 30, 1997 | [JP] | Japan | 9-126452 |
| Aug. 29, 1997 | [JP] | Japan | 9-249905 |

[51] Int. Cl.[7] ..... H01R 13/62

[52] U.S. Cl. ..... 439/310; 439/296

[58] Field of Search ..... 439/296, 299, 439/300, 305, 310, 311, 312, 313, 315, 317, 375, 549, 545, 544, 547, 548, 550, 552, 553, 556, 565, 569, 572

[56] References Cited

U.S. PATENT DOCUMENTS

| | | | |
|---|---|---|---|
| 5,263,871 | 11/1993 | Sano | 439/157 |
| 5,383,797 | 1/1995 | Seong et al. | 439/476 |
| 5,532,436 | 7/1996 | Moyers et al. | 174/151 |
| 5,626,493 | 5/1997 | Post et al. | 439/555 |
| 5,860,822 | 1/1999 | Nishide et al. | 439/206 |

*Primary Examiner*—Lincoln Donovan
*Attorney, Agent, or Firm*—Varndell & Varndell PLLC

[57] ABSTRACT

A connector including a reception housing in which a number of connecting terminals connected to respective conductors are accommodated, an insertion housing in which a number of second connecting terminals connected to respective conductors are accommodated, a holding housing for holding said reception housing, and a spring member arranged between the reception housing and the holding housing. When said insertion housing is inserted into said reception housing, said reception housing is pushed toward the insertion housing and first and second connecting terminals are coupled with each other by a restoring force of the spring means.

20 Claims, 15 Drawing Sheets

CONNECTOR

BACKGROUND OF THE INVENTION

1. Field of the Invention

The present invention relates to a connector comprising a reception housing in which a number of first connecting terminals connected to respective conductors are accommodated and an insertion housing in which a number of second connecting terminals connected to respective conductors are accommodated, said first and second connecting terminals being connected to each other by inserting said insertion housing into said reception housing.

2. Related Art Statement

Recently the number of electric conductors for connecting electric instruments has been increased. To this end, there is generally used a connector. However, since the number of the connecting terminals is increased, it is necessary to insert the insertion housing into the reception housing with a very large force. This apparently inhibits an efficient operation for coupling the reception housing and insertion housing with each other.

SUMMARY OF THE INVENTION

The present invention has for its object to provide a novel and useful connector, in which a number of first connecting terminals accommodated within the reception housing can be easily connected to a number of second connecting terminals accommodated within the insertion housing without requiring a large coupling force of an operator.

According to the invention, a connector comprises:

a reception housing in which a number of first connecting terminals connected to respective conductors are accommodated;

an insertion housing in which a number of second connecting terminals connected to respective conductors are accommodated, said insertion housing being constructed to be inserted into said reception housing;

a holding housing for holding said reception housing; and a pushing means for pushing said reception housing toward said insertion housing to couple said first and second connecting terminals with each other when said insertion housing is inserted into said reception housing over a predetermined distance.

In the connector according to the invention, when the insertion housing is inserted into the reception housing over the predetermined distance, the reception housing is pushed toward the insertion housing by the pushing means and the first connecting terminals are coupled with the second connecting terminals. Therefore, the coupling operation of the first and second connecting terminals can be performed effectively without requiring a large operation force.

DESCRIPTION OF THE PREFERRED EMBODIMENTS

Now the present invention will be explained in detail with reference to the accompanying drawings.

Figure 1:
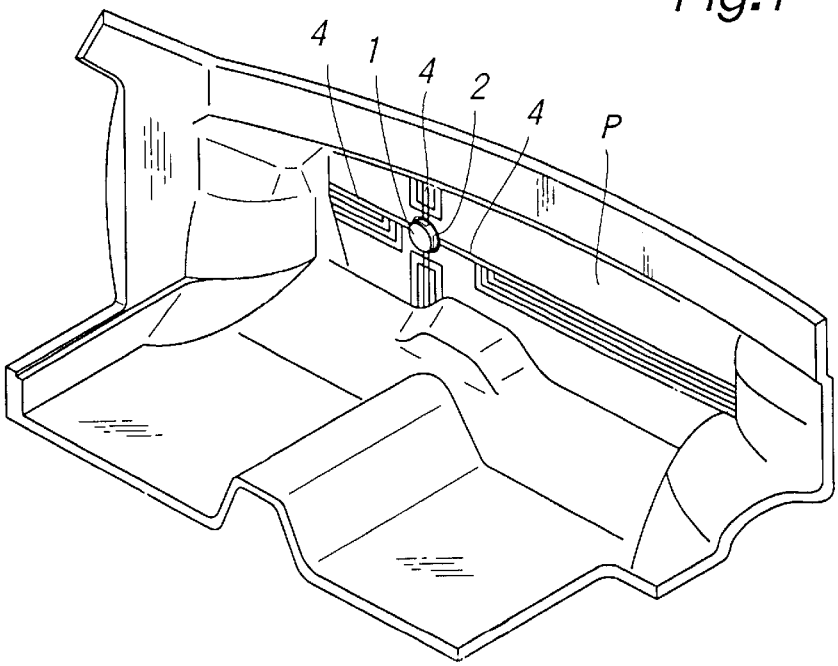
FIG. 1 is a perspective view showing a first embodiment of the connector according to the invention secured to a dash panel of an automobile.

FIG. 1 is a perspective view showing a first embodiment of the connector according to the invention. The connector comprises a reception housing 1 which is fixed to a dash panel P of an automobile by means of a bracket 2 which constitutes a holding housing of the connector according to the invention.

Figure 2:
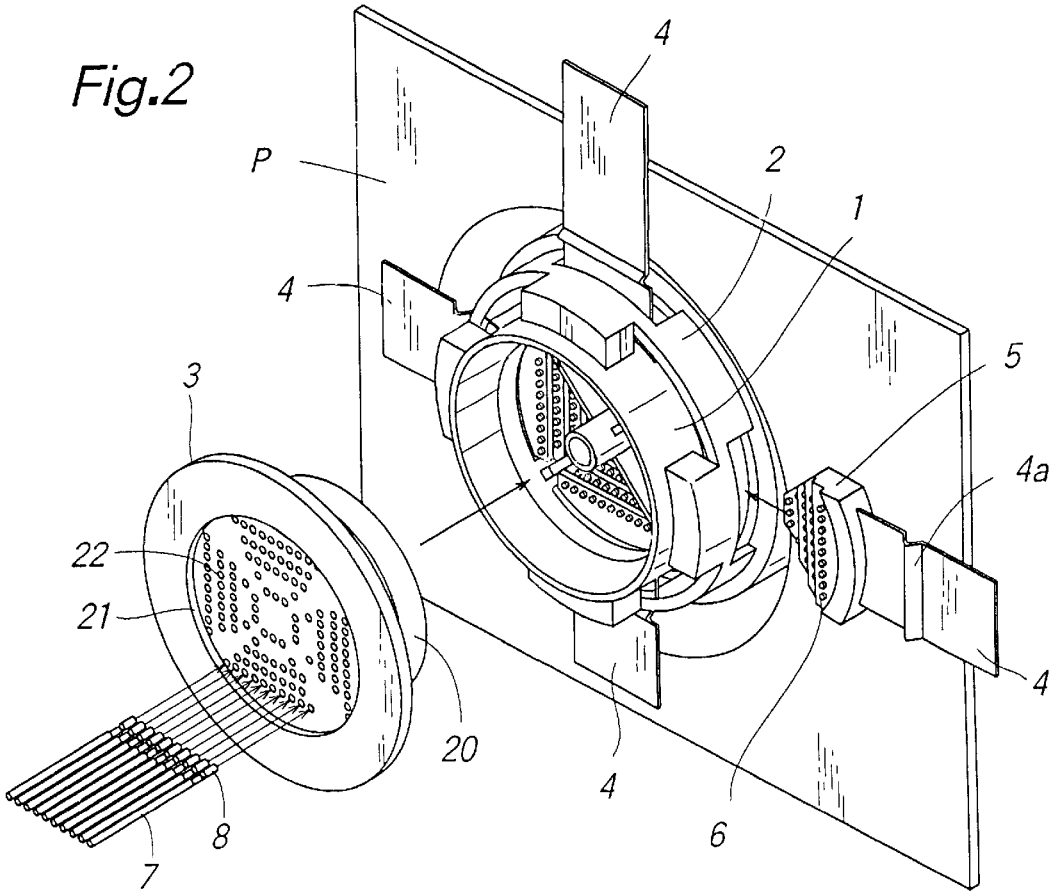
FIG. 2 is a perspective view illustrating a reception housing, an insertion housing and a bracket of the connector shown in FIG. 1.
Figure 3:
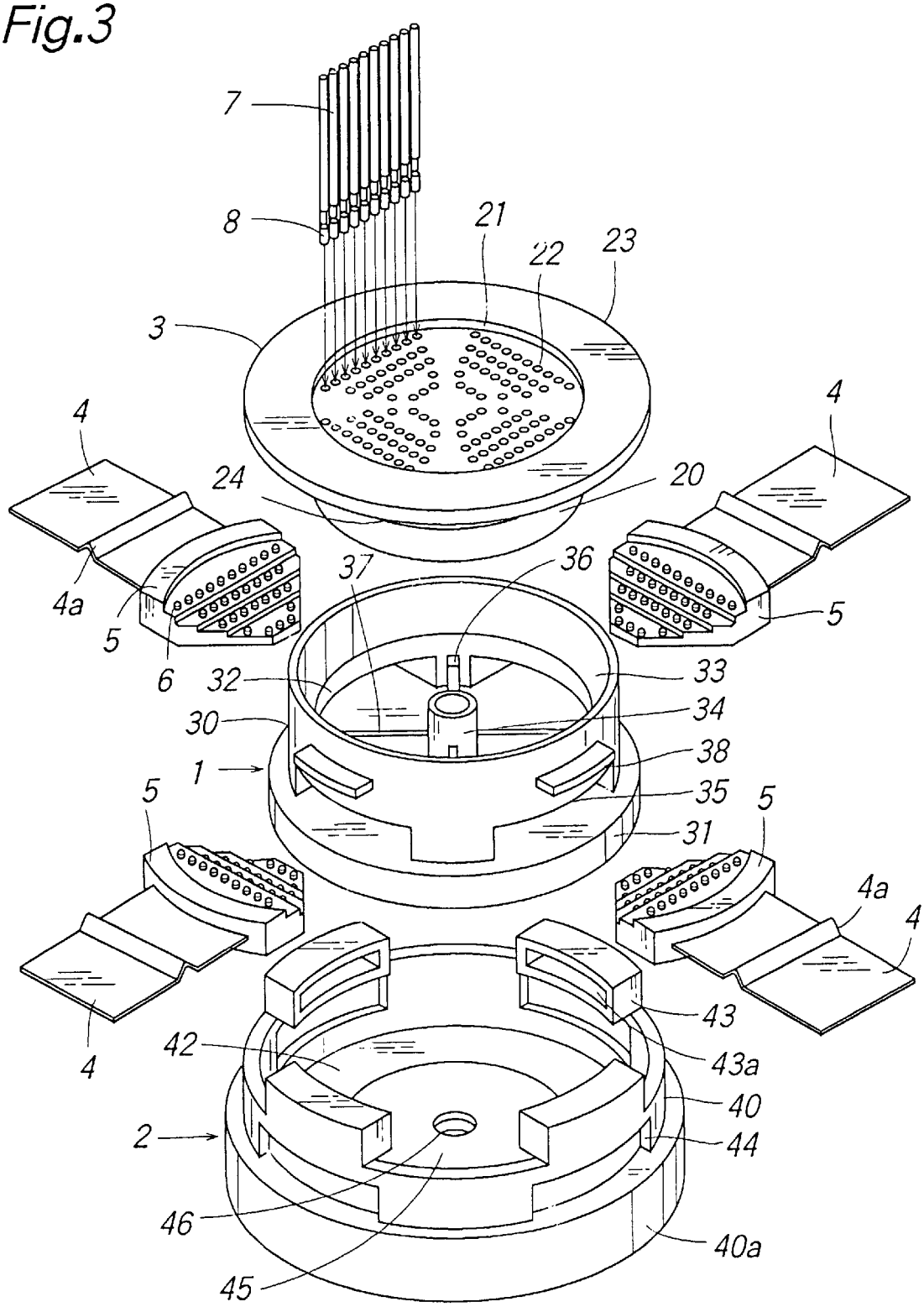
FIG. 3 is an exploded perspective view depicting the reception housing and insertion housing.
Figure 4:
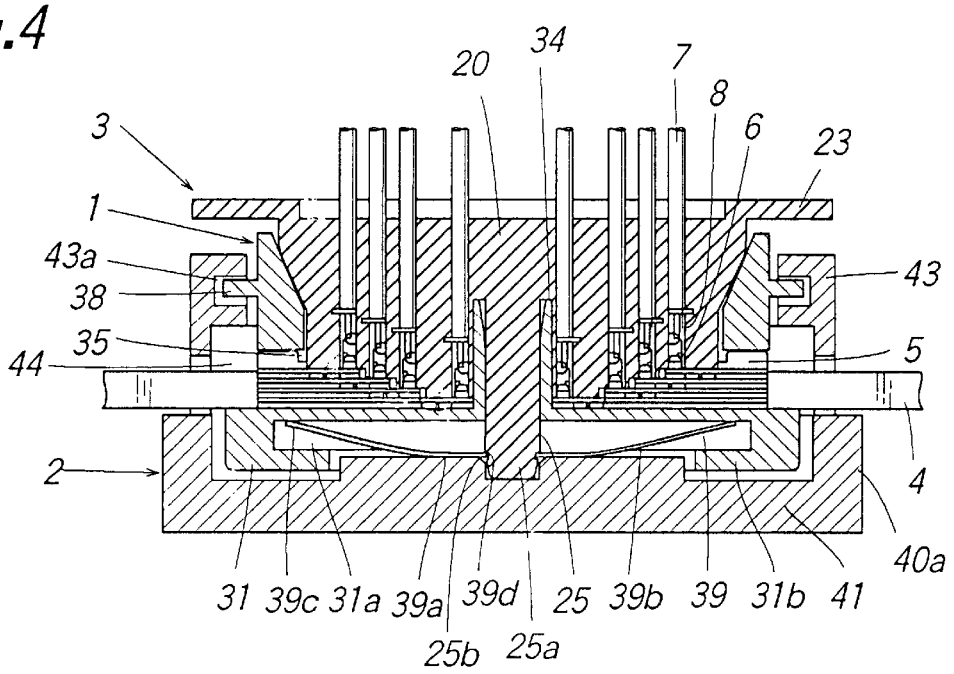
FIG. 4 is a cross sectional view showing an assembled condition of the reception housing, insertion housing and bracket.

FIG. 2 is a perspective view illustrating the reception housing 1 fixed to the dash panel P and an insertion housing 3 to be inserted into the reception housing 1, FIG. 3 is an exploded perspective view depicting the reception housing 1, bracket 2 and insertion housing 3, and FIG. 4 is a cross sectional view showing a condition in which the insertion housing 3 has been finally inserted into the reception housing 1. The reception housing 1, bracket 2 and insertion housing 3 may be formed by molds of electrically insulating plastics.

The bracket 2 is fixed to the dash panel P and the reception housing 1 is secured to the bracket 2 slightly movable up and down, right and left and back and for. The insertion housing 3 is fixed to an instrument panel not shown.

Into the reception housing 1, four end terminals 5 of four laminated flat cables 4 having at least one bent portions 4*a* are to be inserted from mutually orthogonal directions. Each of the end terminals 5 of the laminated flat cables 4 has a substantially sector shape and is made of electrically insulating plastics. The end terminal 5 has a number of male terminals 6 secured thereto. The insertion housing 3 has a number of female terminals 8 secured thereto, each of said female terminals being connected to a respective one of said male terminals 6.

Figure 5:
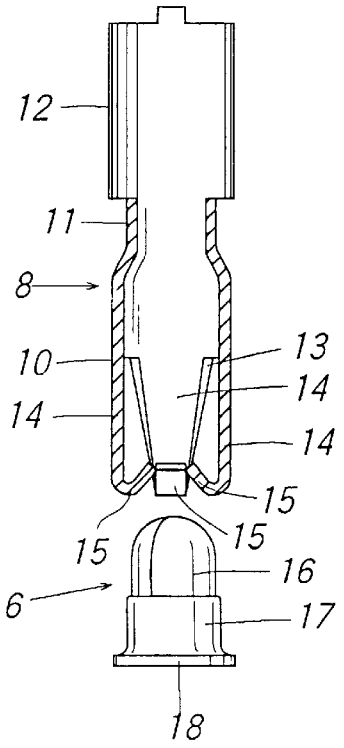
FIG. 5 is a partial cross sectional view depicting a male terminal and a female terminal.

FIG. 5 is a partial cross section of the male terminal 6 and female terminal 8 to which electric wires not shown are to be connected. The female terminal 8 comprises a terminal receiving portion 10 which receives the male terminal 6, a middle portion 11 having a relatively small width, and a clamping portion 12 to which a core conductor of an electric wire 7 may be connected by clamping. The terminal receiving portion 10 has a cylindrical shape and a plurality of recesses, e.g. three recesses 13 are formed therein to form three resilient strips 14. Front ends of these strips 14 are bent inwardly to form resilient contact strips 15 which are resiliently contacted with the male terminal 6.

The male terminal 6 includes a connecting portion 16 which is to be inserted into a space defined by the resilient contact strips 15 of the female terminal 8, and an engaging portion 17 which is to be inserted into a terminal retaining hole formed in a cover for the laminated flat cable 4 as will be explained later. The round front tip of the connecting portion 16 may be formed by bending a plurality of strips, e.g. three strips extending from the engaging portion 17. The male terminal 6 includes a flange 18 which prevents the male terminal 6 from being removed from the end terminal 5.

Figure 6:
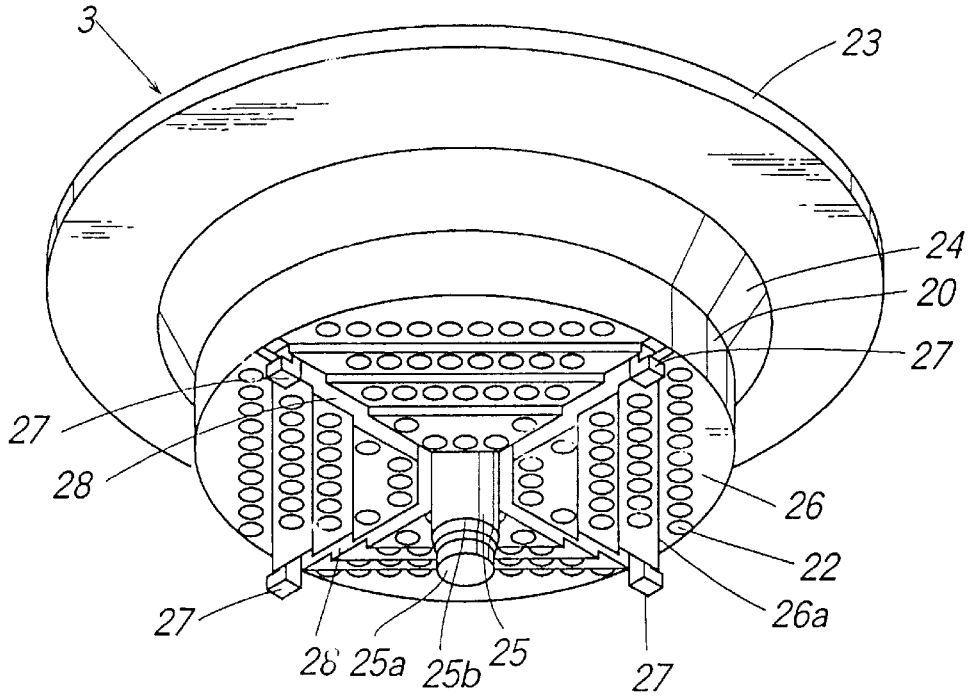
FIG. 6 is a perspective view showing the insertion housing viewed from a bottom thereof.

The insertion housing 3 comprises a cylindrical main body 20, and a recess 21 is formed in a top surface of the main body 20 as shown in FIG. 3. In the main body 20, there are formed a number of terminal retaining holes 22 for receiving the female terminals 8. These holes 22 are aligned along a plurality of lines, and in each line the holes are arranged equidistantly. In each of these holes 22, a female terminal 8 is inserted such that the female terminal could not be removed from the hole. As shown in FIG. 6, a flange 23 is formed at an upper portion of the cylindrical main body 20. Under the flange 23, there is provided a tapered portion 24. On a bottom surface of the cylindrical main body 20, there is provided an axial portion 25 extending downwardly. At a tip of the axial portion 25, there are formed a guide portion 25*a* and a ring-shaped recess 25*b*. In the bottom surface 26 of the cylindrical main body 20, there are formed several step portions 26*a* which are successively lowered toward the axial portion 25. At a periphery of the bottom surface 26 of the cylindrical main body 20, there are provided four retaining projections 27. In the bottom surface 26 of the cylindrical main body 20, there are also formed four radial recesses 28 extending from the axial portion 25 to the retaining projections 27, into said recesses 28 being inserted partitions 37 of the reception housing 2 as will be explained later. The female terminals 8 are inserted into the terminal retaining holes 22 such that their terminal connecting portions 10 are aligned with the bottom surface 26 of the cylindrical main body 20. It should be noted that the recess 21 and flange 23 may be dispensed with.

Figure 7:
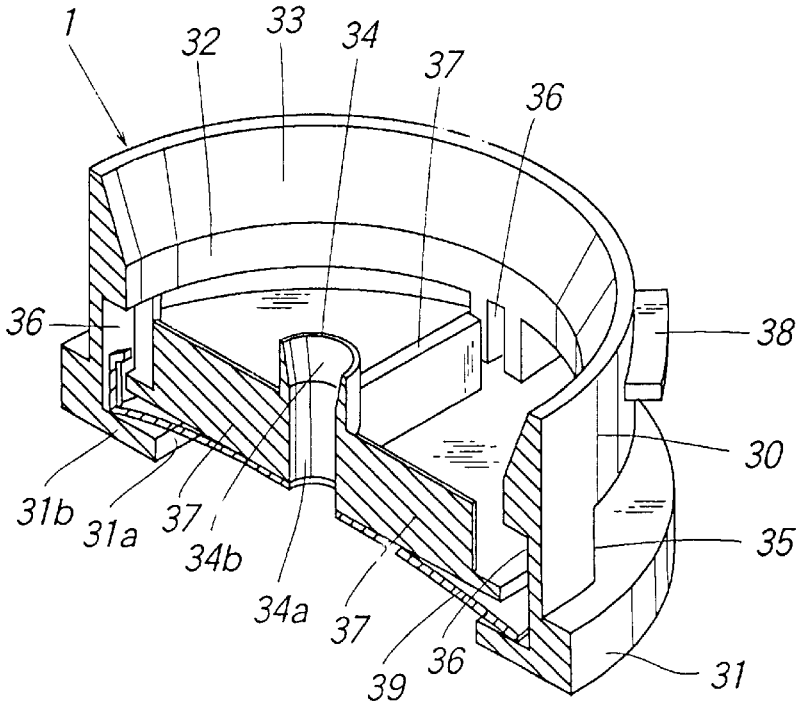
FIG. 7 is a perspective view illustrating the reception housing cut along a longitudinal axis.

As illustrated in FIG. 7, the reception housing 1 comprises a main body 30 and a bottom wall 31. The bottom wall has a larger outer diameter than that of the main body 30, but the outer diameter of the bottom wall 31 may be identical with that of the main body 30. The main body 30 defines a space 32 into which the main body 20 of the insertion housing 3 is firmly inserted, and a tapered hole 33 into which the corresponding tapered portion 24 of the insertion housing 3 is inserted. At the center of the bottom wall 31, there is provided a tubular portion 34 having a hole 34*a* into which is inserted the axial portion 25 of the insertion housing 3. At an upper portion of the hole 34*a*, there is formed a outwardly tapered guide portion 34*b* for guiding the front end of the axial portion 25. In a lower portion of the main body 30, there are formed four cable introducing openings 35 through which the end terminals 5 of the laminated flat cables 4 are inserted into the inner space 32 of the main body 30. The four openings 35 are provided mutually orthogonal directions, so that four end terminals 5 are inserted into the reception housing 1 from orthogonal directions in a plane perpendicular to the inserting direction of the insertion housing 3. In side walls defining the openings 35, there are formed locking recesses not shown for locking the end terminals 5 of the flat cable 4 as will be explained later. In the inner surface of the main body 30, there are formed four slits 36 which are communicated with a ring-shaped leaf spring retaining recess 31*a* defined by the lower surface of the bottom wall 34 and an inner flange 31*b*. Between the slits 36 and the tubular portion 34, there are formed four partitions 37 which are to be inserted into the recesses 28 formed in the bottom surface 26 of the insertion housing 3 when the insertion housing 3 is inserted into the reception housing 1. The partitions 37 divides the inner space 32 of the main body 30 into four sector compartments and the four end terminals 5 of the laminated flat cables 4 are accommodated in these sector compartments. On an outer surface of the main body 30, there are provided four engaging projections 38 which are brought into contact with the bracket 2. A leaf spring 39 made of a metal plate is provided such that a peripheral portion of the leaf spring is inserted into the circular recess 31*a* formed in the bottom wall 31.

Figure 8:
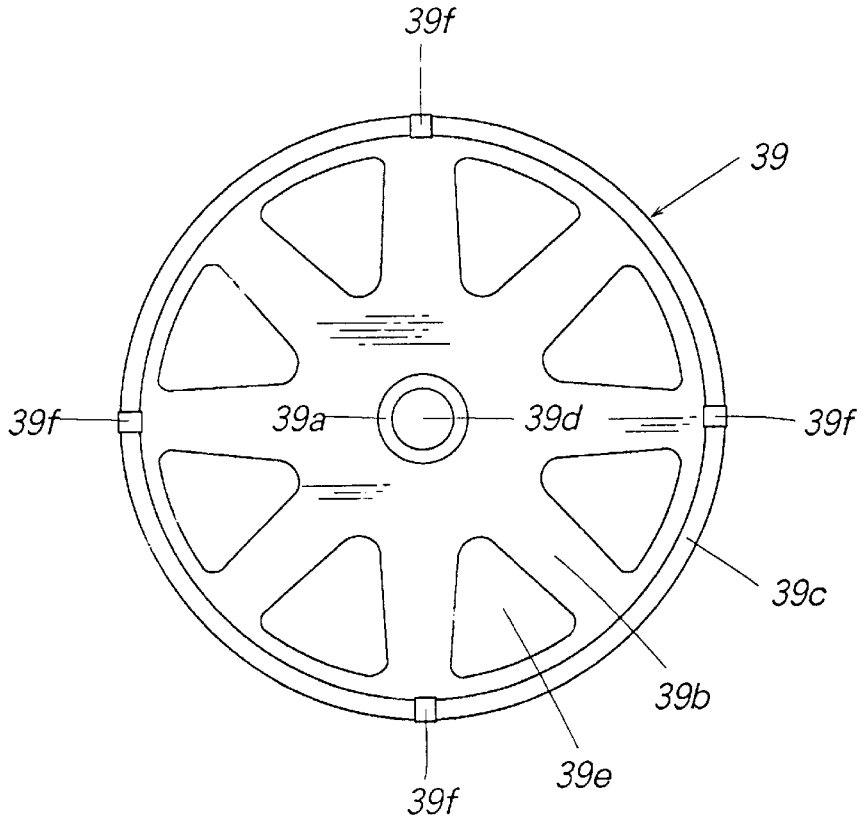
FIG. 8 is a plan view depicting a leaf spring.
Figure 9:
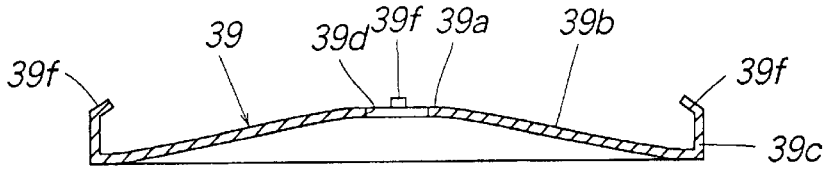
FIG. 9 is a cross sectional view showing the leaf spring cut along the longitudinal axis.

As illustrated in FIGS. 8 and 9, the leaf spring 39 is formed substantially as a belleville spring and comprises a flat central top portion 39*a*, an inclined portion 39*b* descending slowly from the top portion 39*a*, and a peripheral portion 39*c*. The top portion 39*a* of the leaf spring 39 has formed therein a center hole 39*d* into which the axial portion 25 of the insertion housing 3 is forcedly inserted. The inclined portion 39*b* has formed therein a plurality of openings 39*e*. The peripheral portion 39*c* has four engaging projections 39*f*. The peripheral portion 39*c* of the leaf spring 39 inserted into the recess 31*a* of the reception housing 1 is urged against the upper surface of the inner flange 31*b* of the bottom wall 31 and the top portion 39*a* of the leaf spring 39 is urged against the lower surface of the bottom wall 31. It should be noted that the top portion 39*a* of the leaf spring 39 may be curved. Furthermore, it is not always necessary to form the openings 39*e*, but it is advantageous to form the openings 39*e* in order to perform a smooth kick-back of the leaf spring 39.

Figure 10:
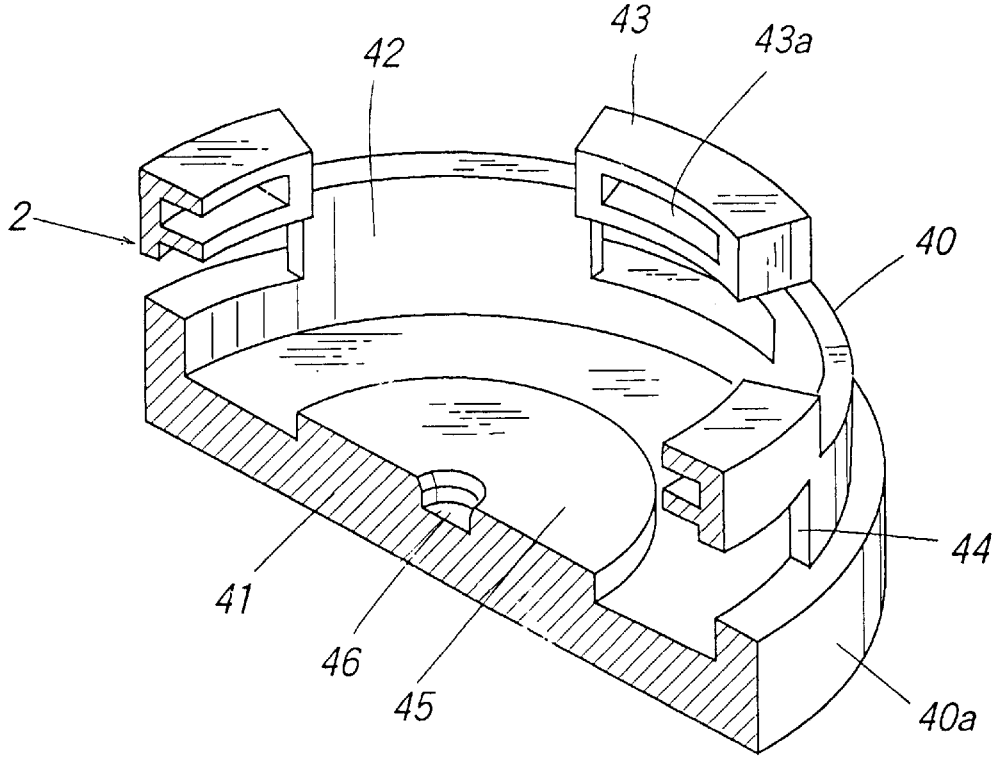
FIG. 10 is a perspective view showing the bracket cut along the longitudinal axis.

As shown in FIG. 10, the bracket 2 constituting the holding housing comprises a cylindrical main body 40 and a bottom wall 41, a lower portion 40*a* of said main body 40 having a larger thickness than that of the remaining portion. The main body 40 and bottom wall 41 define an inner space 42 which accommodates the main body 30 of the reception housing 1. At a front end of the main body 40 there are provided four engaging portions 43 in which engaging recesses 43*a* are formed. The engaging recesses 43*a* can receive the engaging projections 38 of the reception housing 1 in such a manner that the engaging projections can move within the engaging recesses in all directions. In the present embodiment, the lower portion 40 of the main body 40 has a larger thickness than the remaining portion, but it is not always necessary to have a larger thickness as long as the bottom wall 41 has a sufficient large mechanical strength.

In the main body 40, there are formed four cable introducing openings 44 through which the end terminals 5 of the flat cables 4 are inserted into the main body 40. On the upper surface of the bottom wall 41, there; is formed a platform 45 whose diameter is sufficiently smaller than an inner diameter of the inner flange 31*b*. At a center of the platform 45, there is formed a hole 46 into which a front end of the axial portion 25 of the insertion housing 3 is to be inserted through the tubular portion 34 of the reception housing 1.

Figure 11:
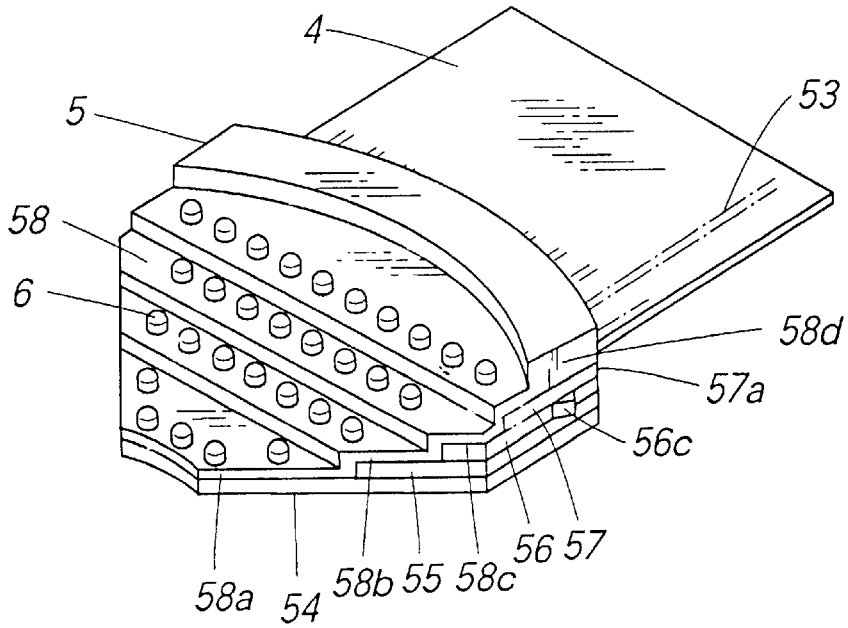
FIG. 11 is a perspective view illustrating the end terminal of the laminated flat cable.
Figure 12:
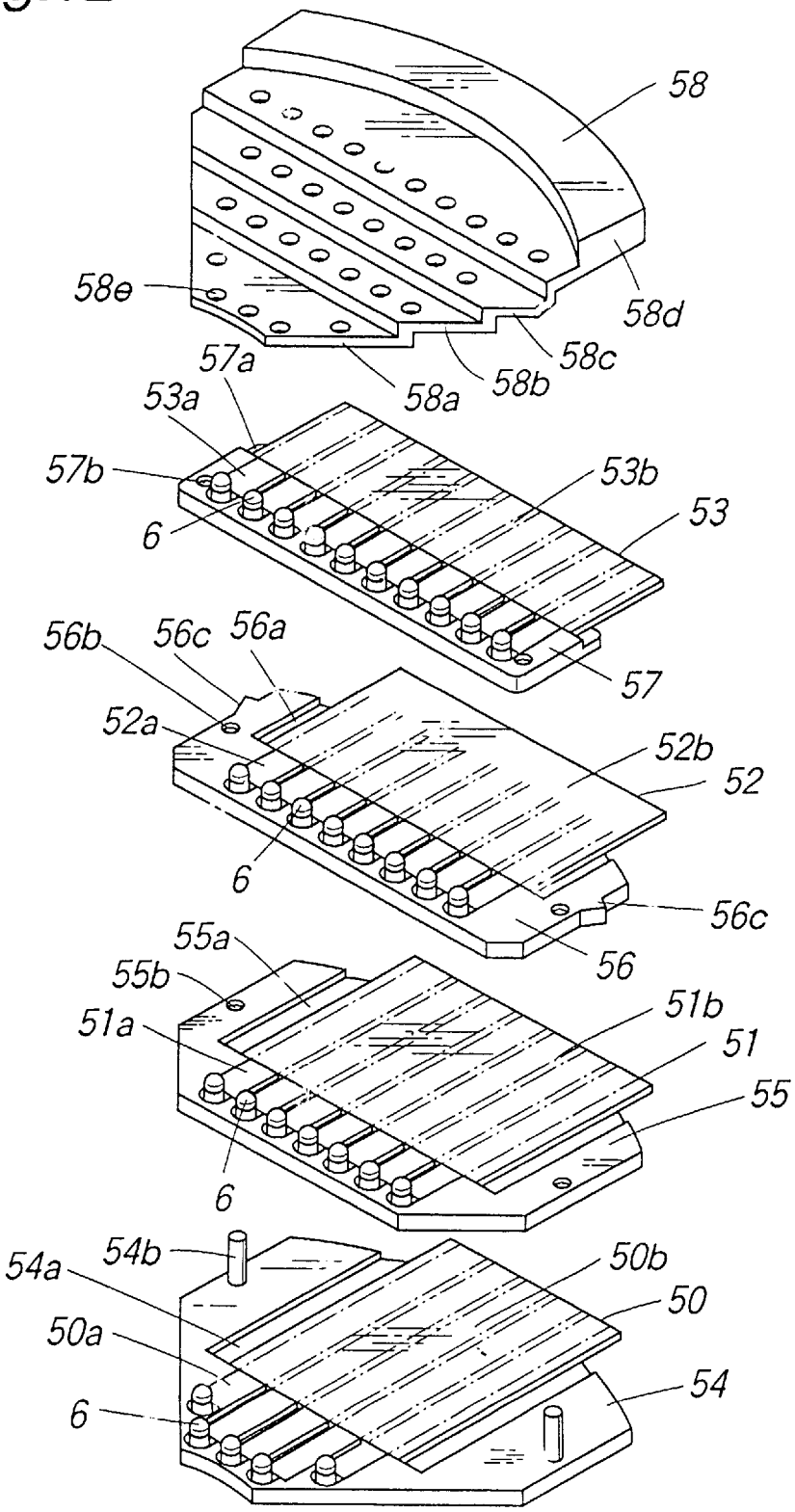
FIG. 12 is an exploded perspective view depicting the structure of the end terminal.
Figure 13:
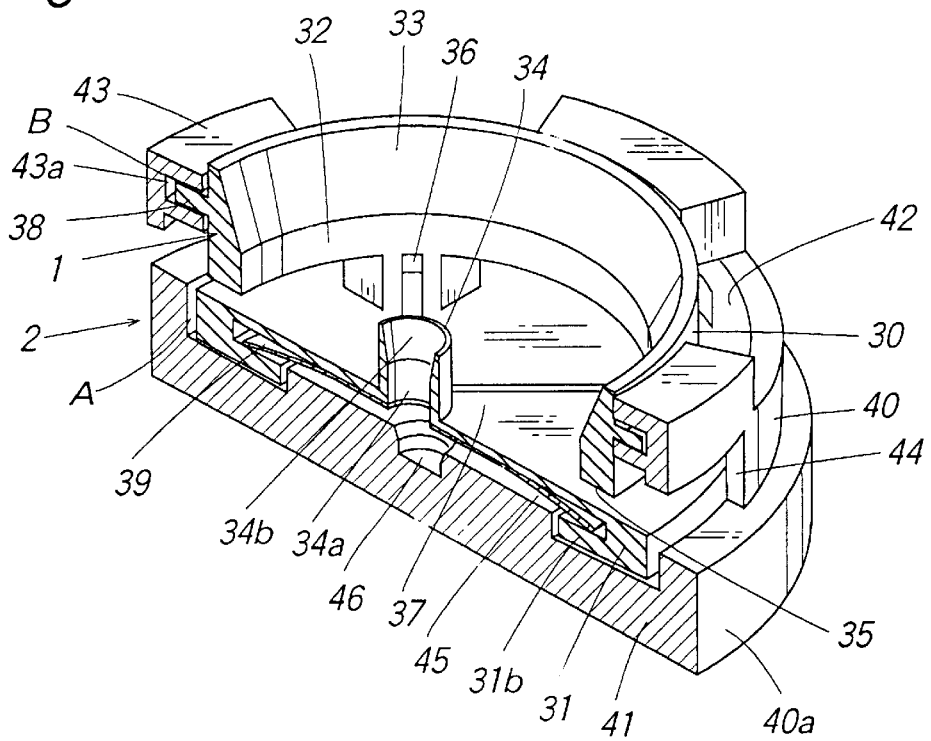
FIG. 13 is a perspective view showing an assembled condition of the reception housing and bracket cut along the longitudinal axis.

FIGS. 11 and 12 are perspective view and exploded perspective views, respectively showing the end terminal 5 of the laminated flat cable 4. The laminated flat cable 4 comprises four flat cables 50–53, and in each of the flat cables foil-shaped conductors 50*a*–53*a* are arranged between insulating sheets 50*b*–53*b*. The laminated flat cable 4 has a sufficient resiliency. A width of the flat cables 50–53 is gradually or successively increased from the bottom one to the uppermost one. To each of the conductors 50*a*–53*a* of the flat cables 50–53 are connected male terminals 6 by any suitable means.

In the end terminal 5 of the flat cable 4, four insulating plates 54–57 are stacked one upon the other such that front ends of these insulating plates are retarded outwardly. The front portion of the insulating plates 54–57 are shaped such that it can be fully inserted into the sector-shaped compartments defined by the adjacent partitions 37 of the reception housing 1. In upper surfaces of the insulating plates 54–57, there are formed recesses 54*a*–57*a* which accommodate parts of the insulating sheets 50*b*–53*b* and exposed conductors 50*a*–53*a* of the flat cables 50–53. On the upper surface of the lowermost insulating plate 54 are provided two pins 54*b*, and in the remaining insulating plates 55–57 are formed holes 55*b*–57*b* for passing the pins therethrough.

On the uppermost insulating plate 57, is provided an insulating cover 58 which has step portions 58*a*–58*d* corresponding to upper surfaces of the insulating plates 54–57. In the insulating cover 58 there are formed a plurality of holes 58*e* through which the male terminals 6 provided on the insulating plates 54–57 are exposed in an assembled condition. The pins 54*b* are inserted into holes formed in a lower surface of the insulating cover 58 to bind the insulating plates 54–57 and insulating cover 58 as shown in FIG. 11. The rear portion of the insulating plates 54–57 and insulating cover 58 is formed in such a shape that it is firmly engaged with the cable introducing opening 35 formed in the reception housing 1. On both sides of the intermediate insulating plate 56, there are locking projections 56*c* which are engaged with the locking recesses formed in both side walls defining the cable introducing opening 35 of the reception housing 1.

Upon assembling the reception housing 1 and bracket 2, at first the leaf spring 39 is fit into the spring retaining recess 31*a*. Then, the reception housing 1 is inserted into the bracket 2 while the engaging portions 43 of the bracket are bent outwardly, and the engaging projections 38 of the reception housing 1 are inserted into the engaging recesses 43*a* of the engaging projections. Then, the lower surface of the reception housing 1 is urged against the upper surface of the bottom wall 41 of the bracket 2 and the platform 45 is inserted into the inner flange 31*b*. Between the bracket 2 and the reception housing 1 there are formed a gap A viewed in the horizontal direction and a gap B viewed in the vertical direction. In this manner, the reception housing 1 can be moved horizontally and vertically. After that, the bracket 2 having the reception housing 1 secured thereto is fixed to the dash panel P.

Figure 14:
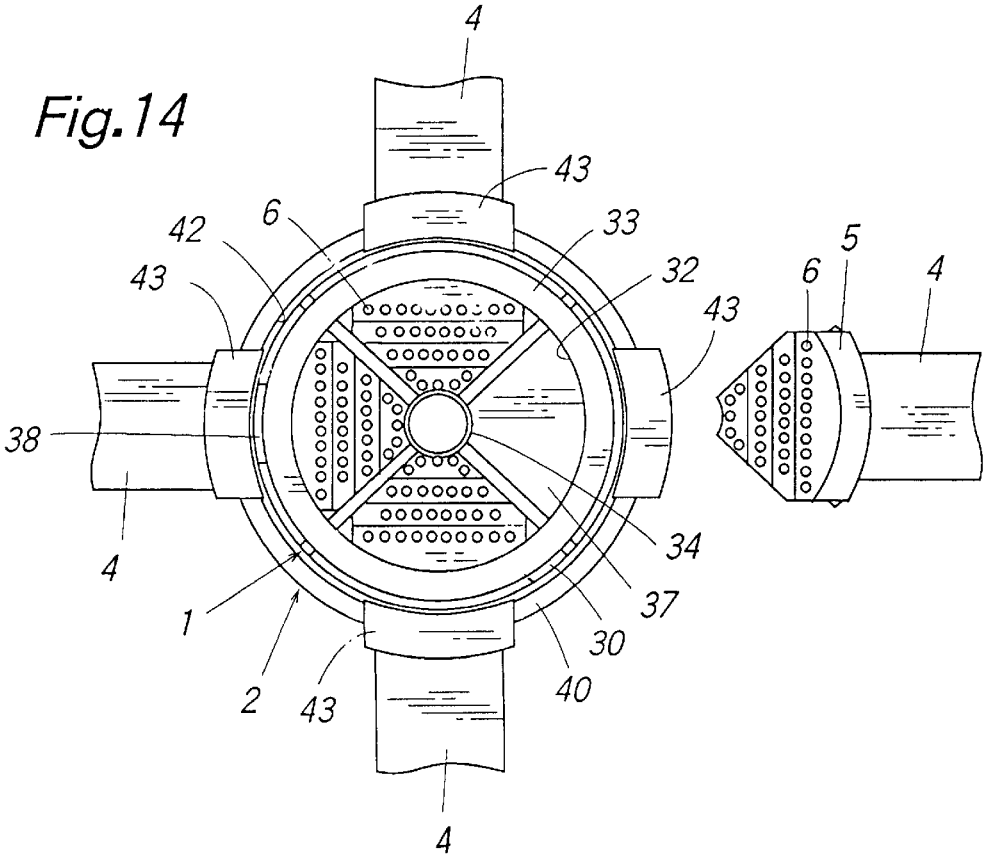
FIG. 14 is a plan view depicting the end terminals inserted into the reception housing.

In order to fix the bracket 2 and laminated flat cables 4 at given positions of the dash panel P as illustrated in FIG. 1, the bracket 1 is fixed to the dash panel P at a position corresponding to the insertion housing 3 secured to the instrument panel and the laminated flat cables 4 except for the folded portions 4*a* and end terminals 5 are adhered to the dash panel P. Then, the end terminals 5 of the laminated flat cables 4 are inserted into the inner space 32 of the reception housing 1 through the cable introducing openings 44 formed in the bracket 2 and cable introducing openings 35 formed in the reception housing 1. Since the laminated flat cables 4 have the folded portions 4*a*, the end terminals 5 can be moved in all directions to improve the easy insertion of the end terminals. In this manner, the end terminal 5 of the laminated flat cable 4 can be inserted into the sector-shaped compartments within the space 32 such that the side walls of the end terminal are brought into contact with the partitions 37 of the reception housing 1 as shown in FIG. 14. In this condition, the locking projections 56*c* of the end terminal 5 are inserted into the locking recesses formed in the side walls of the cable introducing opening 35. During this inserting operation, the portion of the laminated flat cable 4 between the folded portion 4*a* and the end terminal can freely move in accordance with the movement of the reception housing 1. In the manner explained above, four end terminals 5 may be inserted into the space 32 of the reception housing 1 from mutually orthogonal directions in the plane perpendicular to the inserting direction of the insertion housing 3.

Figure 15:
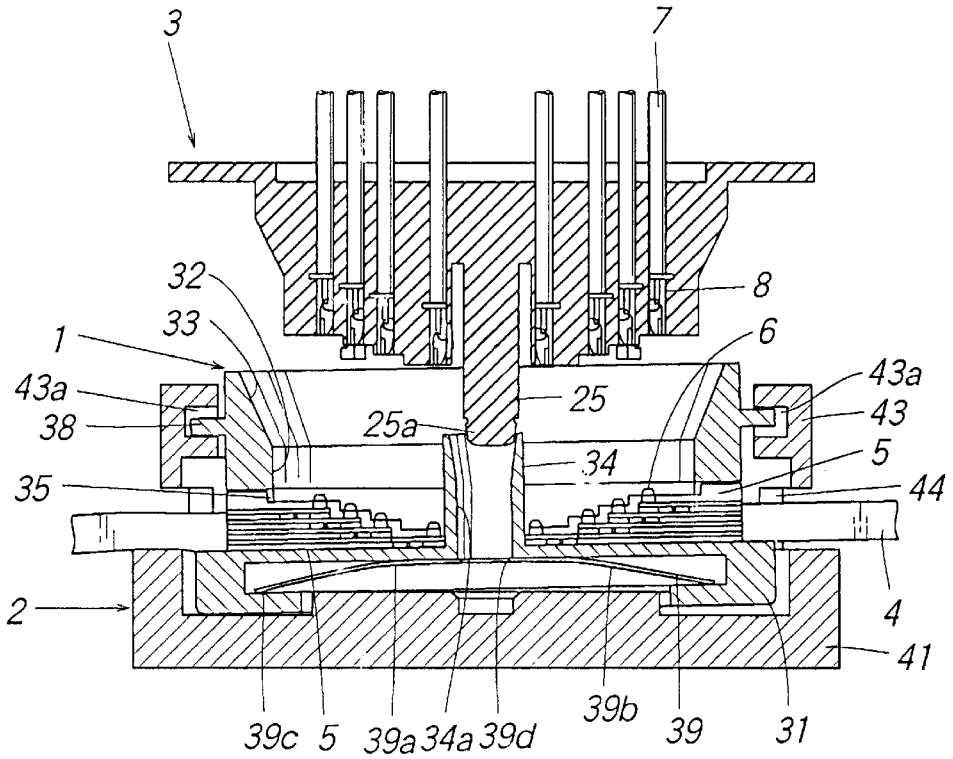
FIGS. 15, 16 and 17 are cross sectional views illustrating successive conditions during the insertion of the insertion housing into the reception housing.

As depicted in FIG. 15, upon securing the instrument panel to the dash panel P, the axial portion 25 of the insertion housing 3 is positioned at the guide hole 34*b* of the tubular portion 34 of the reception housing 1. In this case, in general, the insertion housing 3 is not axially aligned with the reception housing 1, and therefore the reception housing 1 is inclined and at least one of the engaging projections 38 is urged against the lower surface of the engaging recess 43*a* and at least one of the remaining engaging projections is urged against the upper surface of the engaging recess. Similarly, one of the end terminals 5 moves upwardly within the cable introducing openings 35 and 44.

Figure 17:
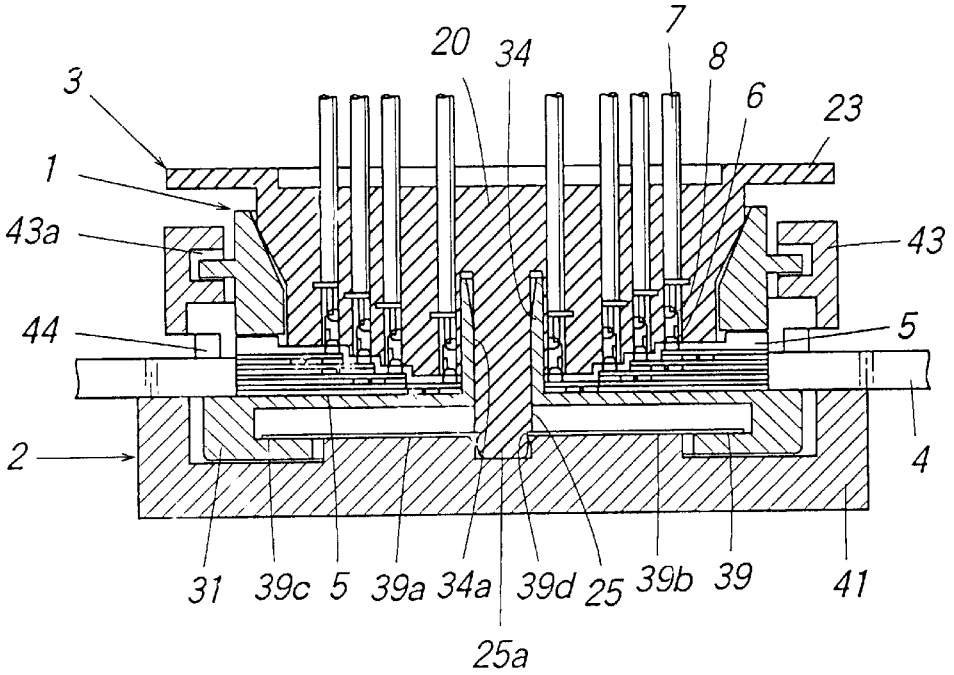

When the instrument panel is pushed toward the connector, the axial portion 25 of the insertion housing 3 is inserted into the hole 34*a* of the tubular portion 34 of the reception housing 1 and the reception housing 1 is swung into the horizontal posture. Then, the partitions 37 of the reception housing 1 are inserted into the recesses 28 of the insertion housing 3, and the guide portion 25*a* of the axial portion 25 is forcedly inserted into the hole 39*d* of the leaf spring 39. When the instrument panel is further pushed, the periphery of the hole 39*d* of the leaf spring 39 is fit into the ring-shaped recess 25*b*, the top portion 39*a* is pressed downward by means of the axial portion 25, and the leaf spring 39 is temporally deformed into the flat posture as illustrated in FIG. 17.

Figure 18:
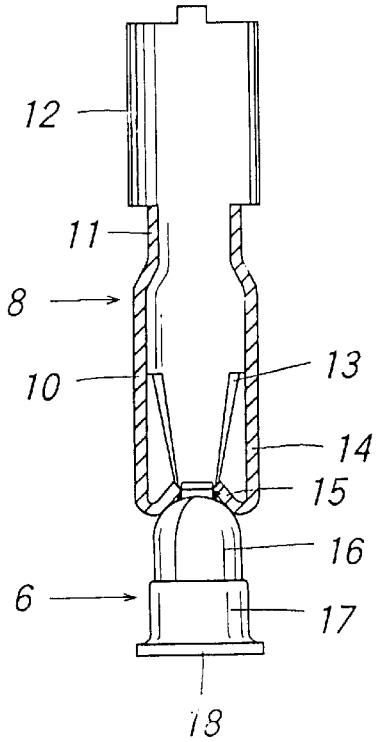
FIG. 18 is a cross sectional view showing a contacting condition of the male and female terminals in the condition shown in FIG. 17.
Figure 19:
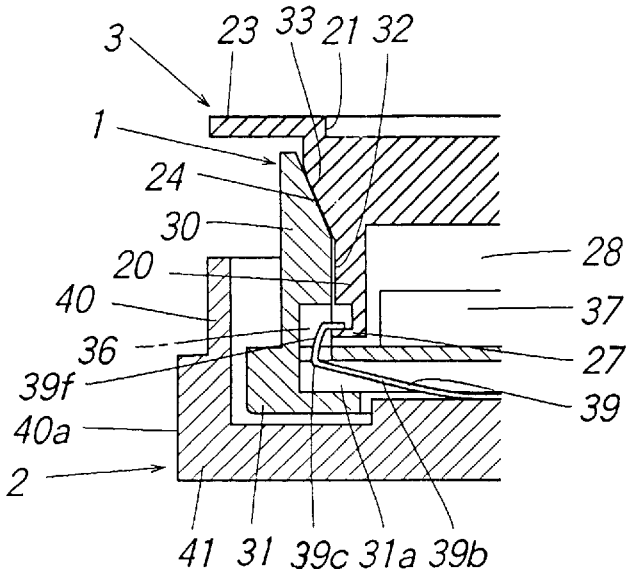
FIG. 19 is a cross sectional view illustrating a part of the finally assembled reception housing and insertion housing.
Figure 20:
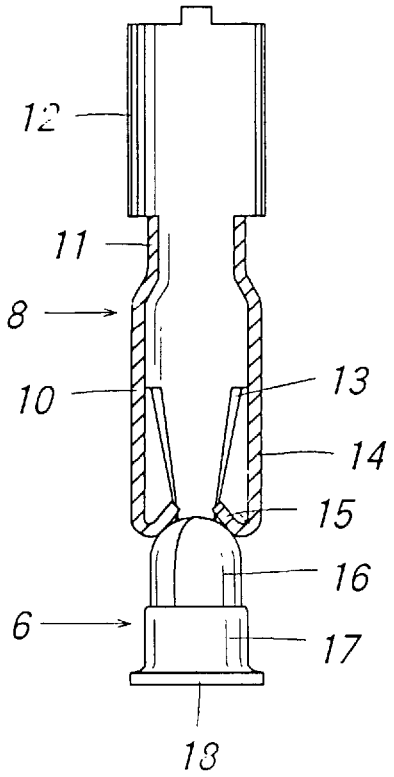
FIG. 20 is a cross sectional view depicting a coupling of the male and female terminals in the finally assembled condition.
Figure 21:
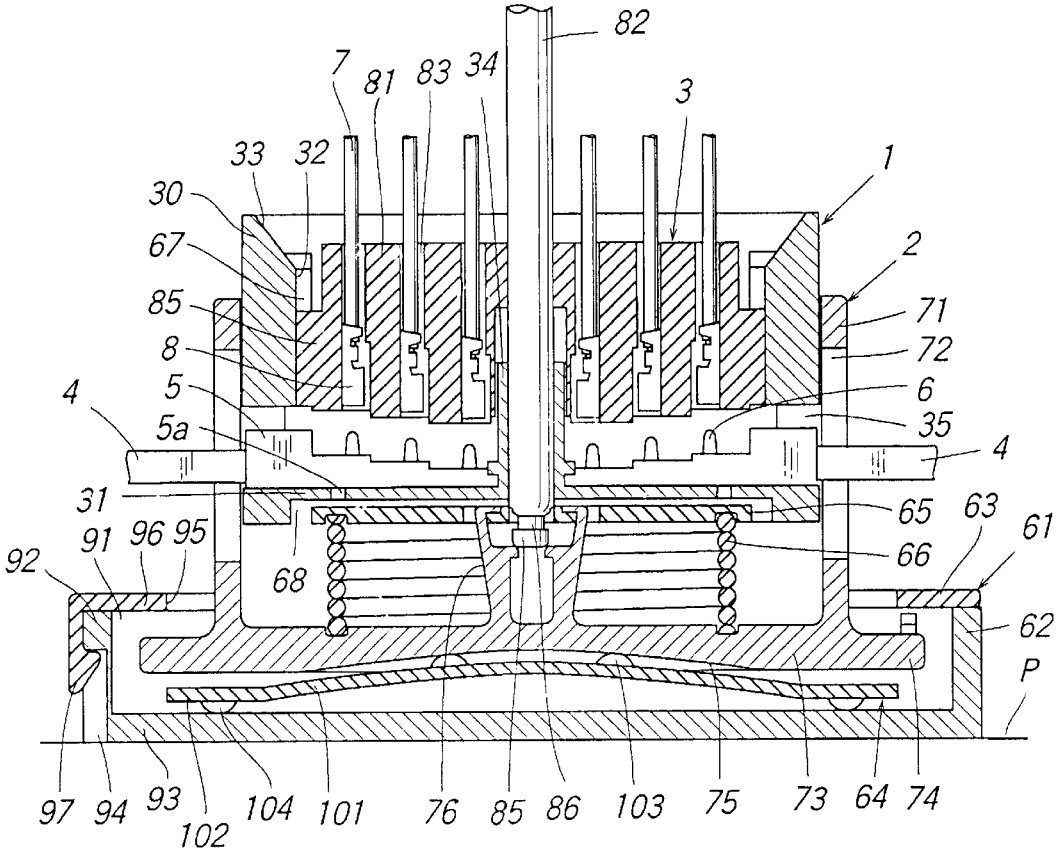
FIG. 21 is a cross sectional view showing a second embodiment of the connector according to the invention.

In this condition, the connecting portion 16 of the male terminal 6 is brought into contact with the resilient strips 15 as shown in FIG. 18. When the instrument panel is finally pushed, the top portion 39*a* of the leaf spring 39 is pushed downward by the axial portion 25 and the leaf spring 39 is kicked-back as shown in FIG. 4. That is to say, the top portion 39*a* of the leaf spring 39 is faced downward and is urged against the bottom wall 41 of the bracket 2. Then, the reception housing 1 is resiliently pushed against the insertion housing 3 by means of the peripheral portion 39*c* of the leaf spring 39. At the same time, as depicted in FIG. 19, the engaging portions 39*f* of the leaf spring 39 are bent inwardly and are engaged with the engaging projections 27 of the insertion housing 3 through the slits 36 formed in the reception housing 1. In this condition, the connecting portion of the male terminal 6 is inserted between the resilient strips 15 of the female terminal 8. In this manner, all the male terminals 6 are simultaneously connected to the corresponding female terminals 8 in a positive manner.

Figure 16:
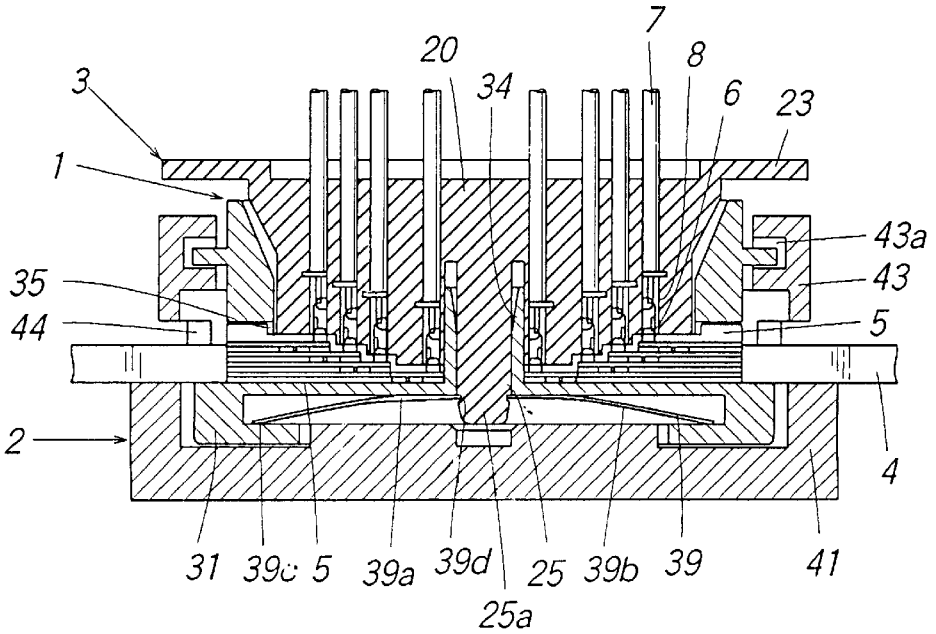

When the instrument panel is removed from the dash panel P, the insertion housing 3 is pulled out of the reception housing 1. Since the axial portion 25 of the insertion housing 3 is fit in the hole 39*d* of the leaf spring 39, the leaf spring is pulled and is turned over again into the original posture in which the top portion 39*a* is faced upwardly as shown in FIG. 16. In this manner, the insertion housing 3 can be easily removed from the reception housing 1.

It should be noted that the leaf spring 39 may be formed in any desired shape in accordance with a configuration of the reception housing 1. Further, a strength of the leaf spring 39 can be adjusted by suitably selecting material, thickness and shape of the leaf spring.

FIGS. 21–28 show a second embodiment of the connector according to the invention. In the present embodiment, portions similar to those of the first embodiment are denoted by the same reference numerals used in the first embodiment. In a condition shown in FIG. 21, the insertion housing 3 has been inserted into the reception housing at a half way. The insertion housing 3 is secured to an instrument panel not shown, said instrument panel being fixed to the dash panel P. Into the reception housing 1, the four end terminals 5 of laminated flat cables 4 have been inserted from mutually orthogonal four directions. A number of male terminals 6 have been secured to the end terminal 5 and a number of corresponding female terminals 8 have been accommodated within the insertion housing 3 to each of which respective one of the electric wires 7 has been connected.

A holding member 61 comprises a main body 62 which is secured to the dash panel P and which accommodates a lower portion of the bracket 2 in such a manner that the bracket can move in all directions, and a retaining member 63 which prevents the bracket from being removed from the holding member 61. In the present embodiment, the bracket 2 and holding member 61 constitute the holding housing. Within the main body 62, there is arranged a guide member 64 having a convex spherical surface which receives a corresponding concave spherical surface of the bottom wall of the bracket 2. Within the bracket 2, there is arranged a compressed coil spring 66 which pushes the reception housing 1 to the insertion housing 3 by means of a movable plate 65.

Like as the first embodiment, the reception housing 1 comprises the main body 30 having the inserting hole 32 and tapered hole 33 into which the insertion housing 3 is inserted. At the center of the bottom wall 31 of the reception housing 1, there is provided the tubular portion 34 into which an axial portion 82 is inserted. In the inner surface of the inserting hole 32 there are formed guide recesses which guide the insertion housing 3.

In the main body 30 of the reception housing 1, there re formed four cable introducing openings 35 through which he end terminals 5 of the laminated flat cables 4 are inserted into the main body 30. The end terminals 5 are retained within the reception housing 1 by means of engaging projections 5*a* formed on bottom surfaces of the end terminals and engaging recesses formed in the upper surface of the bottom wall 31 of the reception housing 1. In the lower surface of the bottom wall 31, there is formed a recess 68 in which the movable plate 65 is accommodated movably in the axial direction.

The bracket 2 comprises a cylindrical main body 71 into which the main body 30 of the reception housing 1 is inserted firmly. In the main body 71 there are formed four cable introducing openings 72 through which the end terminals 5 of the laminated flat cables 4 can be inserted into the openings 35 formed in the main body 30 of the reception housing 1. A bottom wall 73 of the bracket 2 has a flange 74, and in the lower surface of the bottom wall 73 there is formed the concave spherical surface 75. At the center portion of the bottom wall 73 there is formed a retaining member 76 which retains the movable plate 65 in a detachable manner and retains the insertion housing 3.

The insertion housing 3 comprises a cylindrical main body 81 made of a synthetic resin and the axial member 82 made of a metal. In the main body 81 there are formed a number of terminal accommodating holes 83 which accommodate a number of female terminals 8. On the outer surface of the cylindrical main body 81 of the insertion housing 3, there are formed projections 85 which are inserted into the guide recesses 65 formed in the reception housing 1, and thus the rotation of the insertion housing 3 with respect to the reception housing 1 can be limited. At a tip of the axial member 82, there is formed a guide surface 85 which guides the engaging member 76 of the bracket 2. Furthermore, near the guide surface 85, there is formed a ring-shaped recess 86 which engages with the engaging member 76.

The main body 62 of the holding member 61 comprises a side wall 92 which defines a space 91 in which the flange 74 of the bracket 2 can be accommodated with a certain allowance, and a bottom wall 93 which is secured to the dash panel P. In the outer surface of the side wall 92 there are formed retaining recesses 94 which retain the retaining member 63. The retaining member 63 of the holding member 61 comprises a ring-shaped plate 96 defining an opening 95 which is sufficiently larger than an outer diameter of the main body 71 of the bracket 2, but is smaller than an outer diameter of the flange 74. Retaining projections 97 are provided along the periphery of the ring-shaped plate 96.

The guide member 64 may be made of synthetic resin or metal and includes a convex spherical surface portion 101 which corresponds to the concave spherical surface 75 of the bottom wall 73 of the bracket 2, and a ring-shaped flat surface portion 102 which extends in parallel with the flat surface of the bottom wall 93 of the box member 61. Around the center of the spherical surface portion 101 there are provided at least three semispherical small projections 103, and on the lower surface of the flat surface portion 102 there are also provided at least three semispherical small projections 104.

Figure 22:
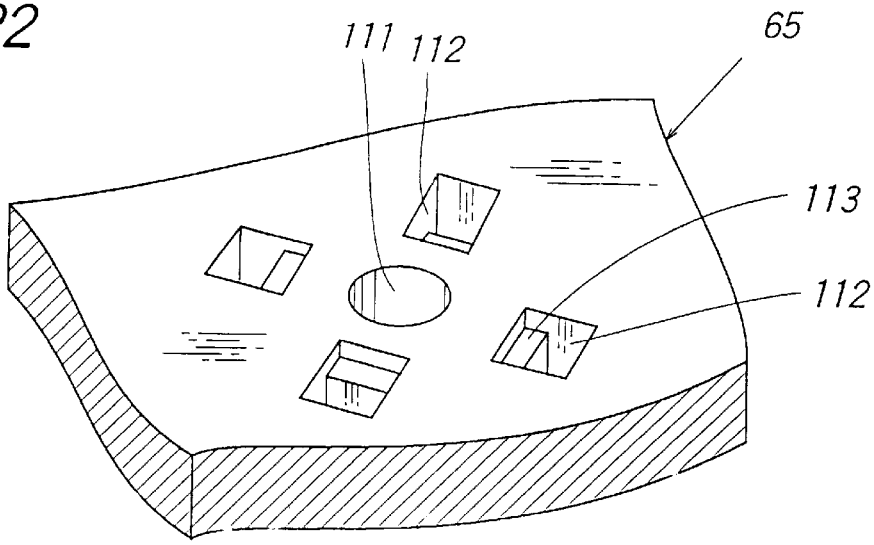
FIG. 22 is an enlarged perspective view illustrating a part of a movable plate.

As shown in FIG. 22, at a center of the movable plate 65, there is formed a central hole 111 through which the axial member 82 is passed. Around the center hole 111, there are further formed holes 112 through which resilient strips of the retaining member 76 are passed. In an inner surface of the hole 112 there is formed a recess 113 which engages with an upper projection formed on the resilient strip.

Figure 23:
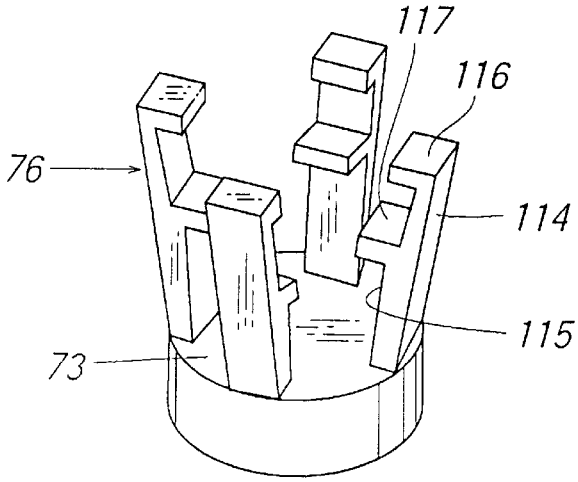
FIG. 23 is a perspective view depicting a retaining member of the bracket.

As illustrated in FIG. 23, the retaining member 76 comprises four resilient strips 114 extending from the upper surface of the bottom wall 73. The resilient strips 114 are inserted into the holes 112 formed in the movable plate 65. The resilient strip 114 includes a stem portion 115 which is resiliently deformed outwardly by means of the axial member 82. The resilient strip 114 further comprises an upper projection 116 which is engaged with the recess 113 in the hole 112 of the movable plate 65 and a lower projection 117 which is engaged with the ring-shaped recess 86 of the axial member 82.

Upon assembling the connector of the present invention, at first the coil spring 66 and movable plate 65 are successively arranged on the bottom wall 73 of the bracket 2. Then the movable plate 65 is pushed downward against the force of the coil spring 66 until the upper projections 116 of the resilient strips 114 of the retaining member 76 are engaged with the recesses 113 formed in the inner surfaces of the holes 112. After arranging the guide member 64 within the main body 62 of the box member 61, the bracket 2 is placed on the guide member 64 and the retaining member 63 is secured to the main body 62. In this manner, the bracket 2 is supported by the box member 61 movably in all directions.

Next, the insertion housing 3 is secured to the instrument panel at a desired position and the box member 61 is secured to the dash panel P at a given position. While the reception housing 1 has been inserted into the bracket 2, the end terminals 5 of the laminated flat cables 4 are inserted into the reception housing through the cable introducing openings 72 and 35, and the end terminals 5 are fixed in position by means of the engaging projections 5*a*. After that, the remaining portions of the laminated flat cables 4 are secured to the dash panel P. In this manner, the reception housing 1 is firmly held by the bracket 2.

Figure 24:
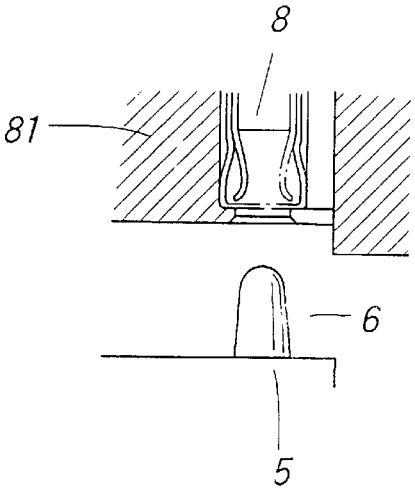
FIG. 24 is a partial cross sectional view showing a male and female terminals in a condition shown in FIG. 21.

Then, the dash panel P having the reception housing 1 secured thereto and the instrument panel having the insertion housing 3 secured thereto are assembled, and the main body 81 of the insertion housing 3 is inserted into the tapered hole 33 and hole 32 successively. During this inserting operation, the reception housing 1 and bracket 2 are also moved downward and the insertion housing 3 is aligned with the reception housing 1. Then, the concave spherical surface 75 of the bottom wall 73 of the bracket 2 is urged against the small projections 103 and is smoothly moved along the spherical surface of the guide member 64. In this manner, the male terminal 6 is aligned with the female terminal 8 as shown in FIG. 24. It should be noted that in this condition, there is a small air gap between the male terminal 6 and female terminal 8.

Figure 25:
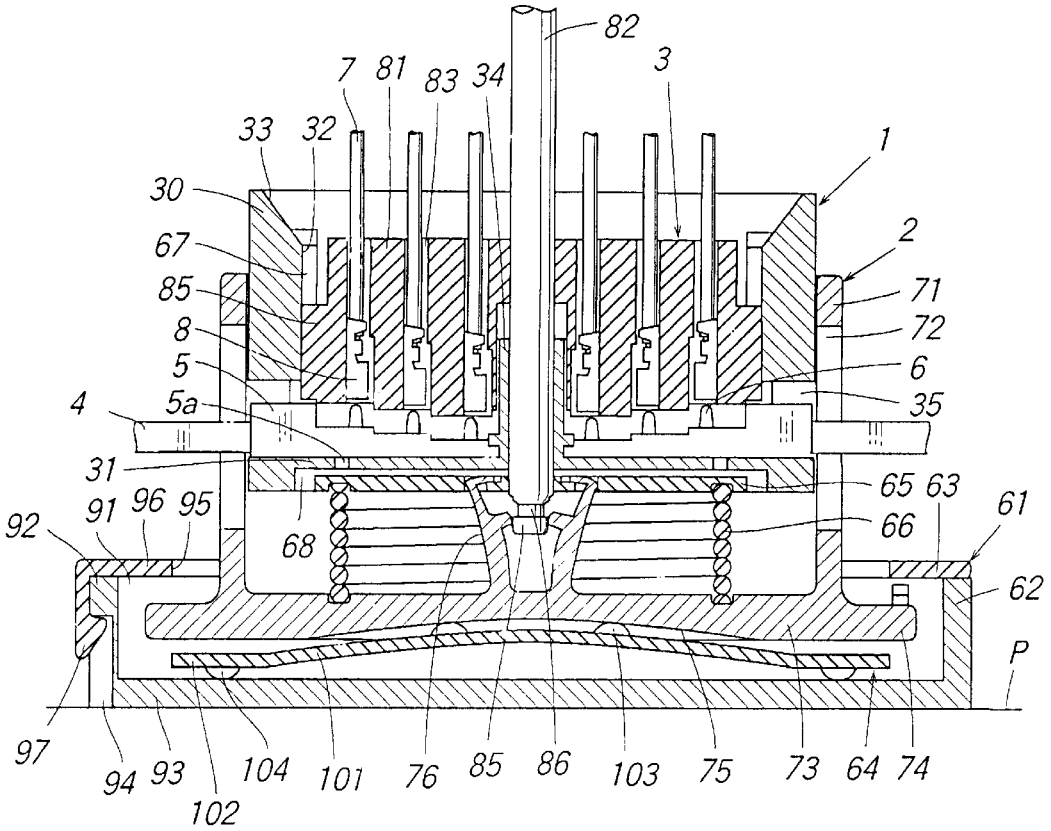
FIG. 25 is a cross sectional view illustrating the coupling operation.
Figure 26:
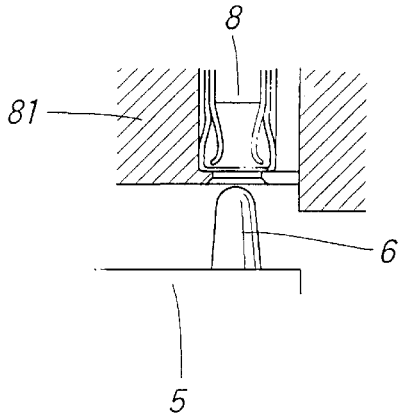
FIG. 26 is a partial cross sectional view depicting the male and female terminals in a condition of FIG. 25.

When the instrument panel is further pushed against the dash panel P, the axial member 82 of the insertion housing 3 is passed through the tubular member 34 of the reception housing 1 and the central hole 111 of the movable plate 65 and the guide surface 85 of the axial member 82 is brought into contact with the lower projections 117 of the resilient strips 114 of the retaining member 76 as illustrated in FIG. 25. In this condition, the male terminal 6 and female terminal 8 are substantially contacted with each other.

Figure 27:
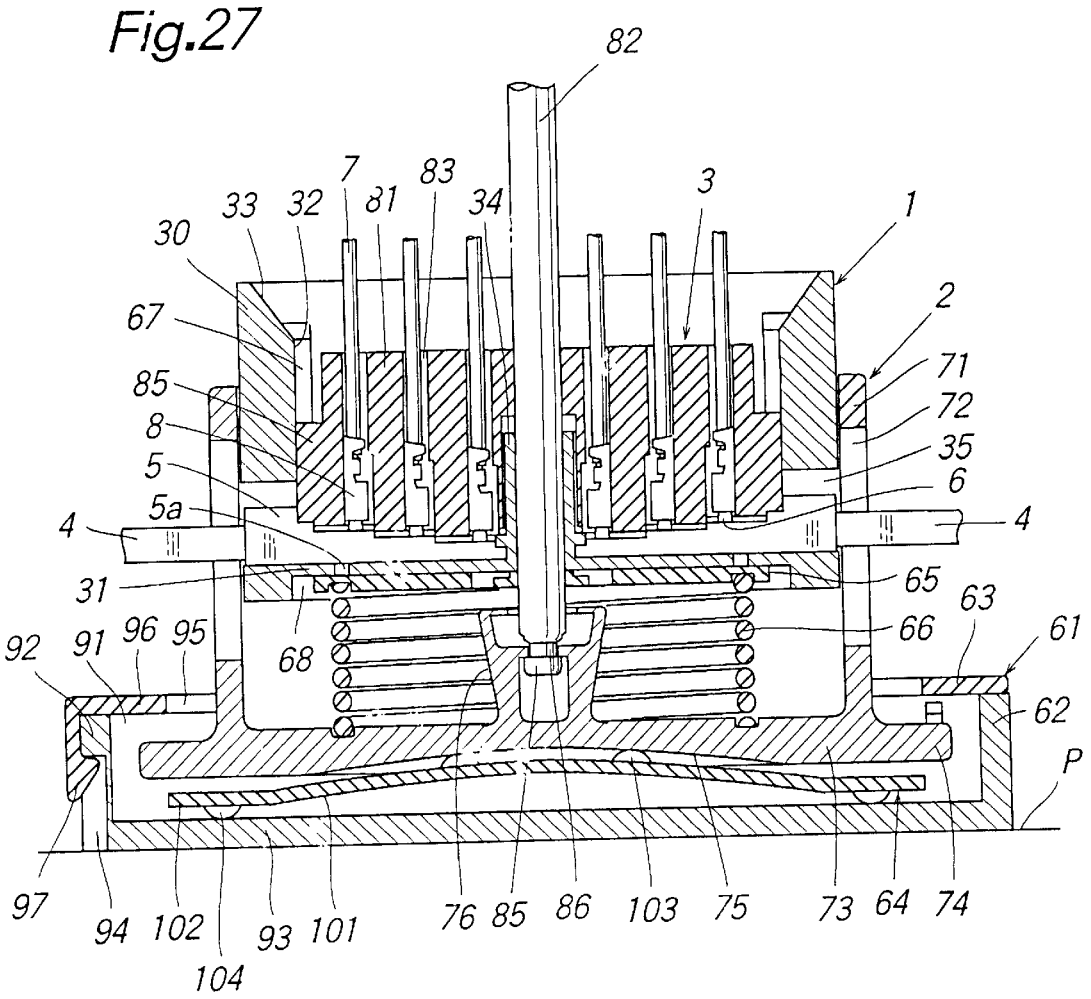
FIG. 27 is cross sectional view showing the finally assembled condition of the reception and insertion housings.
Figure 28:
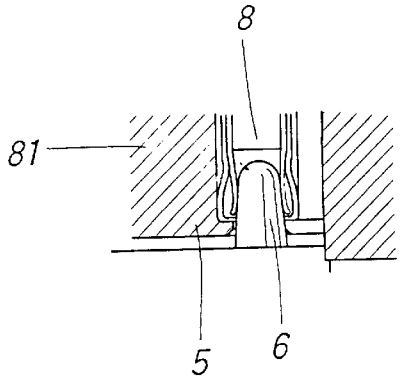
FIG. 28 is a partial cross sectional view illustrating the male and female terminals in the finally assembled condition.

Then, the instrument panel is pushed against the dash panel P into the final position, the axial member 82 is further inserted into the bracket 2 and the lower projections 117 of the retaining member 76 are inserted into the ring-shaped recess 86 of the axial member 82. In this manner, the insertion housing 3 is retained within the reception housing 1 by means of the axial member 82 and retaining member 76. At the same time, the stem portions 115 of the resilient strips 114 are pushed outwardly by the axial member 82 and the upper projections 117 are disengaged from the recesses 113 formed in the inner surfaces of the holes 112 as shown in FIG. 27. Therefore, the movable plate 65 is released from the bracket 2 and is moved upward by the force of the coil spring 66. Therefore, the reception housing 1 is pushed upward and is urged against the insertion housing 3. By this movement of the reception housing 1, the male terminal 6 is inserted into the female terminal 8 as depicted in FIG. 28.

As explained above, in the present embodiment, the retaining member 76 of the bracket 2 retains the axial portion 82 of the insertion housing 3 until the insertion housing is fully inserted into the reception housing 1, and then the movable plate 65 is released and the reception housing 1 is urged against the insertion housing 3 by means of the coil spring 66. In this manner, the male terminals 6 can be effectively inserted into the female terminals 8 without requiring a large force.

In the second embodiment, the one coil spring 66 is provided, according to the invention, a plurality of coil springs may be arranged around the retaining member 76. Moreover, in the second embodiment, the axial member 82 of the insertion housing 3 is retained by the retaining member 76 such that the bracket 2 and insertion housing 3 are separated from each other by a given distance. However, the bracket 2 and insertion housing 3 may be separated by a given distance by fixing the instrument panel to the dash panel. Further, the insertion housing 3 and bracket 2 may be locked by means of locking mechanisms provided in respective members. It should be further noted that the reception housing 1 may be urged against the insertion housing 3 by means of air pressure force, magnetic force, restoring force of rubber, water pressure force, oil pressure force or explosion pressure; force instead of the spring force.

In the above embodiments, the conductors of the laminated flat cables are connected to the electric wires, but according to the invention, any electric conductors may be connected by means of the first and second connecting terminals.

What is claimed is:

1. A connector comprising:

a reception housing in which a number of first connecting terminals connected to respective conductors are accommodated;

an insertion housing in which a number of second connecting terminals connected to respective conductors are accommodated, said insertion housing being constructed to be inserted into said reception housing;

a holding housing for holding said reception housing; and a pushing means for pushing said reception housing toward said insertion housing to couple said first and second connecting terminals with each other when said insertion housing is inserted into said reception housing over a predetermined distance; said pushing means comprising a Belleville spring arranged between said reception housing and said holding housing under such a condition that a restoring force is reserved, so that when said insertion housing is not inserted into said reception housing, said Belleville spring having a convex shape viewed in an insertion direction of the insertion housing prior to inserting of said insertion housing in said reception housing, and when said insertion housing is inserted into the reception housing, and Belleville spring is pushed by the insertion housing and is forced into a concave shape viewed in the inserting direction.

2. A connector according to claim 1, wherein said insertion housing includes an axial portion and said reception housing includes a hole, said axial portion and hole being constructed such that when the insertion housing is inserted into the reception housing, said axial portion of the insertion housing passes through said hole and pushes said leaf spring until the leaf spring is turned-over.

3. A connector according to claim 2, wherein said leaf spring has a center hole formed therein, and when said insertion housing is inserted into said reception housing, a tip portion of said axial portion of the insertion housing is inserted into said center hole and is engaged therewith.

4. A connector according to claim 1, wherein said leaf spring has a plurality of projections extending from a peripheral portion of the leaf spring toward the reception housing, and said projections are moved inwardly when the leaf spring is turned over.

5. A connector according to claim 4, wherein said projections of the leaf springs have engaging portions which are engaged with said insertion housing when the leaf spring is turned over and said projections are moved inwardly.

6. A connector according to claim 1, wherein said pushing means comprises a coil spring.

7. A connector according to claim 6, wherein said coil spring is provided between the holding housing and the reception housing in a compressed condition.

8. A connector according to claim 7, wherein said holding housing includes a bottom wall, a movable plate and a retaining member provided on the bottom wall for retaining said movable plate, and said coil spring is arranged between said bottom wall and said movable plate in a compressed condition.

9. A connector according to claim 8, wherein said insertion housing includes an axial member, said reception housing includes a hole through which said axial member of the insertion housing is passed, and said insertion housing is retained by retaining said axial member by said retaining member of the holding housing.

10. A connector according to claim 9, wherein said movable plate is released from said retaining member when said retaining member is deformed by engaging said axial member with the retaining member.

11. A connector according to claim 1, wherein said reception housing includes a plurality of compartments formed within an inner space of the reception housing, and a plurality of end terminals having said number of first connecting terminals secured thereto are inserted into said plurality of compartments from side directions perpendicular to an axial direction of the reception housing.

12. A connector according to claim 11, wherein said first connecting terminals are provided on the end terminals such that first connecting terminals are directed perpendicularly to said side directions from which the end terminals are inserted into said compartments of the reception housing.

13. A connector according to claim 11, wherein said first connecting terminals are provided on the end terminals such that the first connecting terminals are directed perpendicularly to a plane of the flat cable.

14. A connector according to claim 11, wherein in each of said end terminals, the first connecting terminals are aligned along a plurality of lines, and in each of said lines the first connecting terminals are arranged substantially equidistantly.

15. A connector according to claim 11, wherein in each of said end terminals, said first connecting terminals are arranged substantially equidistantly in a zigzag manner.

16. A connector according to claim 11, wherein each of said first connecting terminals is formed by a male terminal and each of said second connecting terminals is formed by a female terminal which cooperates with said male terminal.

17. A connector according to claim 11, wherein said reception housing comprises four sector-shaped compartments, and four sector-shaped end terminals are inserted into said four compartments from mutually orthogonal directions in a plane perpendicular to a direction for inserting the insertion housing into the reception housing.

18. A connector according to claim 16, wherein said reception housing comprises four radial partitions defining said four sector-shaped compartments, and said sector-shaped end terminals are inserted into the compartments until side walls of the end terminals are urged against said partitions.

19. A connector according to claim 16, wherein said reception housing includes a plurality of openings through which said end terminals are inserted into said compartments.

20. A connector according to claim 18, wherein each of said end terminals includes a locking mechanism for locking the end terminal to the reception housing in the inserted condition.

* * * * *